US006311578B1

(12) United States Patent
Kohlen

(10) Patent No.: US 6,311,578 B1
(45) Date of Patent: Nov. 6, 2001

(54) PEDAL

(75) Inventor: Peter Kohlen, Wehrheim (DE)

(73) Assignee: Mannesmann VDO AG, Frankfurt (DE)

( * ) Notice: Subject to any disclaimer, the term of this patent is extended or adjusted under 35 U.S.C. 154(b) by 0 days.

(21) Appl. No.: 09/423,929

(22) PCT Filed: May 6, 1998

(86) PCT No.: PCT/EP98/02655

§ 371 Date: Feb. 28, 2000

§ 102(e) Date: Feb. 28, 2000

(87) PCT Pub. No.: WO98/51525

PCT Pub. Date: Nov. 19, 1998

(30) Foreign Application Priority Data

May 15, 1997 (DE) ..... 197 20 390

(51) Int. Cl.[7] ..... G05G 1/14

(52) U.S. Cl. ..... 74/513; 267/275; 192/81 C

(58) Field of Search ..... 74/512, 513, 514, 74/560; 267/214, 275; 192/81 C; 464/57

(56) References Cited

U.S. PATENT DOCUMENTS

| | | | | |
|---|---|---|---|---|
| 2,541,947 | * | 2/1951 | Starkey | 192/81 C |
| 2,939,561 | * | 6/1960 | Rudisch | 192/81 C |
| 3,149,706 | * | 9/1964 | Mason et al. | 192/81 C |
| 3,500,701 | * | 3/1970 | Gussenbauer et al. | 74/513 |
| 3,550,736 | * | 12/1970 | Lang | 192/81 C |
| 3,709,339 | * | 1/1973 | Austin et al. | 192/81 C |
| 3,731,773 | * | 5/1973 | Austin et al. | 192/81 C |
| 3,750,784 | * | 8/1973 | Shum, Jr. | 192/81 C |
| 3,750,785 | * | 8/1973 | Smith et al. | 192/81 C |
| 4,018,104 | * | 4/1977 | Bland et al. | 74/513 |
| 4,576,762 | * | 3/1986 | Griffin et al. | 267/275 |
| 4,869,220 | * | 9/1989 | Imoehl | 74/513 |
| 4,869,357 | * | 9/1989 | Batchelder | 192/81 C |
| 4,944,269 | * | 7/1990 | Imoehl | 74/513 |
| 4,958,607 | * | 9/1990 | Lundberg | 123/399 |
| 5,078,371 | * | 1/1992 | Joseph et al. | 74/514 |
| 5,233,882 | * | 8/1993 | Byram et al. | 74/514 |
| 5,295,409 | * | 3/1994 | Byram et al. | 74/514 |
| 5,385,068 | * | 1/1995 | White et al. | 74/512 |
| 5,408,899 | * | 4/1995 | Steward | 74/514 |
| 5,416,295 | * | 5/1995 | White et al. | 74/560 |
| 5,438,516 | * | 8/1995 | Neubauer et al. | 74/514 |
| 5,697,260 | * | 12/1997 | Rixon et al. | 74/514 |
| 5,768,946 | * | 6/1998 | Fromer et al. | 74/514 |
| 5,812,050 | * | 9/1998 | Figgins | 74/513 |
| 5,868,040 | * | 2/1999 | Papenhagen et al. | 74/513 |

FOREIGN PATENT DOCUMENTS

| | | |
|---|---|---|
| 19517172 | 11/1996 | (DE) . |
| 19536699 | 4/1997 | (DE) . |
| 8907706 | 8/1989 | (WO) . |

* cited by examiner

*Primary Examiner*—David A. Bucci
*Assistant Examiner*—Chong H. Kim
(74) *Attorney, Agent, or Firm*—Martin A. Farber

(57) ABSTRACT

A pedal having a pedal arm (3) which is mounted pivotably and is prestressed into an initial position by a restoring spring (5), which is designed as a leg spring, has a frictional damper (7) having a slotted sleeve (8) whose end regions overlap and are prestressed against each other. As the pedal arm is being pressed down, the diameter of the sleeve (8) is reduced by the restoring spring (5), so that the end regions slide over each other and damp the movement of the pedal arm (3).

13 Claims, 2 Drawing Sheets

PEDAL

FIELD AND BACKGROUND OF THE INVENTION

The invention relates to a pedal having a pedal arm which is mounted pivotably in a retaining part, can be deflected, by means of a pedal plate, by the force of a foot, and can be pivoted back into an initial position by at least one restoring spring, having a desired-value generator for producing an electrical signal as a function of the position of the pedal arm, and having a frictional damper for damping the movement of the pedal arm.

Pedals of this type are used, for example, as a gas pedal in a motor vehicle having an electronic load control system and are therefore known. The frictional damper generally has a friction pad which is prestressed against a friction surface by means of a spring. When the pedal arm moves, the friction pads slides over the friction surface and therefore prevents the movement of the pedal arm, in particular when the latter is released, from being instantaneously transmitted to the desired-value generator. In this connection, the friction produced in the frictional damper in the actuating direction of the pedal arm is generally greater than in the opposite direction. The frictional damper produces a force hysteresis which damps the deflection of the pedal arm and therefore prevents the foot which is actuating the pedal from swinging freely. When the pedal is installed, the friction pad can be prestressed in accordance with and aligned in accordance with against the friction surface the intended friction. As a result, the pedal consists of a very large number of components which are complicated to manufacture and install.

SUMMARY OF THE INVENTION

The invention is based on the problem of providing a pedal of the type mentioned at the beginning in such a manner that it has as few components as possible and can be installed in a particularly simple manner.

According to the invention, this problem is solved by the frictional damper having a slotted sleeve with two end regions which overlap and are prestressed against each other, and an actuating element for producing a relative movement of the end regions when the pedal arm moves.

This design means that in order to produce the envisaged damping the pedal according to the invention requires only the sleeve as a single component for the friction pad and the friction surface. The pedal according to the invention therefore consists of particularly few components. The required damping of the frictional damper can be defined by the prestressing of the end regions and the choice of material for the sleeve and therefore no longer has to be set when the pedal is being installed. As a result, the pedal is particularly simple to install.

The actuating element could be designed, for example, as a strap which is wound around the sleeve and could prestress the sleeve as the pedal arm is being pressed down. The end regions of the sleeve thereby slide over each over and thus produce the intended friction. However, the pedal according to the invention has particularly small dimensions if the restoring spring is designed as a leg spring, and the sleeve bears with its outer circumference against the inside of the restoring spring. Since, as the pedal arm is being pressed down, the restoring spring, which is designed as a leg spring, reduces its diameter and therefore prestresses the sleeve, this design means that the frictional damper does not require an actuating element to be installed separately.

A relative movement between the sleeve and the restoring spring could result in damage to the sleeve and the restoring spring. According to another advantageous development of the invention, a relative movement of this type can-be avoided in a simple manner if an end region of the sleeve is fastened on the retaining part.

According to another advantageous development of the invention, the sleeve can be prevented from remaining in a compressed state if the outside end region of the sleeve is fastened on the restoring spring.

According to another advantageous development of the invention, the sleeve can be manufactured from any desired material, irrespective of the required frictional force, if the sleeve has a friction lining on its end regions. It is thereby possible for the sleeve to be manufactured, for example, from an elastic synthetic material or from spring steel, in accordance with the intended prestressing force of its end regions. A suitable synthetic material is, in particular, polyacetal.

According to another advantageous development of the invention, the sleeve can be manufactured with the friction lining in a particularly cost-efficient manner if the sleeve has a coating as the friction lining.

According to another advantageous development of the invention, a coefficient of friction, which is required for the intended friction, at the end regions of the sleeve can be produced in a simple manner if the sleeve or the friction lining has fillers.

According to another advantageous development of the invention, the friction is virtually constant over the entire travel of the pedal arm if the fillers of the friction lining comprise Teflon.

According to another advantageous development of the invention, the friction lining is connected reliably to the sleeve if the friction lining is sintered onto the sleeve. A further advantage of this design resides in the fact that virtually any desired coefficients of friction can be produced by the sintering on of an extremely wide range of materials.

BRIEF DESCRIPTION OF THE DRAWINGS

The invention permits numerous embodiments. To further clarify its basic principle one of these embodiments is illustrated in the drawings and is described in the following. In the drawings.

DETAILED DESCRIPTION OF THE PREFERRED EMBODIMENT

Figure 1:
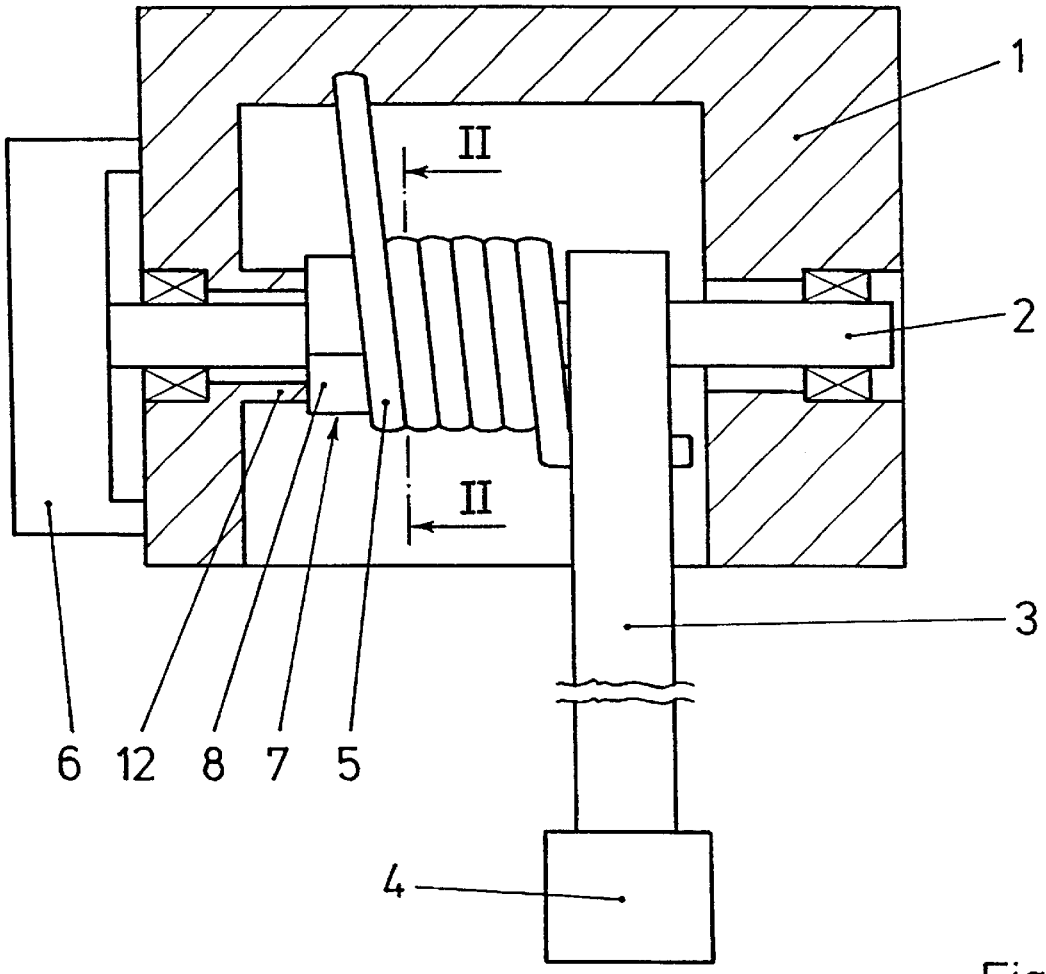
FIG. 1 shows a schematic representation of a pedal according to the invention.

FIG. 1 shows a pedal assembly according to the invention having a shaft 2 which is mounted pivotably in a retaining part 1. A pedal arm 3 having a pedal plate 4 is fastened on the shaft 2. The pedal assembly furthermore has a restoring spring 5, which is designed as a leg spring, is fastened at one end in the retaining part 1 and with the other end partially engages around the pedal arm 3. The pedal arm 3 is thereby prestressed into an initial position. A desired-value generator 6 is fastened on the retaining part 1. The desired-value generator 6 produces electrical signals as a function of the setting angle of the shaft 2. The movement of the pedal arm 3 is damped by a frictional damper 7 having a slotted sleeve 8 which is arranged within the restoring spring 5.

Figure 2:
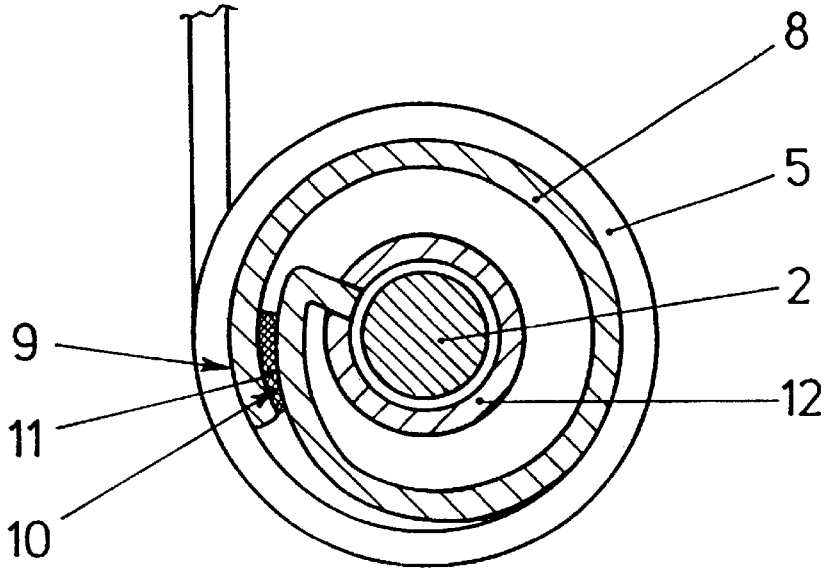
FIG. 2 shows a sectional representation through the pedal from FIG. 1 along the line II—II.

FIG. 2 shows the sleeve 8 and the restoring spring 5 in an enlarged sectional representation along the line II—II from FIG. 1. The sleeve 8 has overlapping end regions 9, 10. One of the end regions 9 bears a friction lining 11 on its side which faces the second end region 10. The sleeve 8 or the friction lining 11 has fillers. The second end region 10 is fastened on a peripheral edge 12 of the retaining part 1, while the first end region 9 bears against the inside of the restoring spring 5. As the pedal arm 3, which is shown in FIG. 1, is being pressed down, the restoring spring 5 stretches and as it does so reduces its diameter. The sleeve 8 is compressed by this means. The end regions 9, 10 of the sleeve 8 slide over each other and damp the movement of the pedal arm 3. As the pedal arm 3 is being pressed down, the damping is greater than as it is being released. The frictional damper 7 produces a force hysteresis. The damping ensures that the desired-value generator 6 moves in a reliable and trouble-free manner.

What is claimed:

1. A pedal assembly comprising a pedal arm which is mounted pivotably in a retaining part, the pedal arm being deflectable, by a metal plate, by force of a foot, and being pivotable back into an initial position by at least one restoring spring, a desired-value generator for producing an electrical signal as a function of position of the pedal arm, and a fictional damper for damping movement of the pedal arm, wherein the frictional damper (7) has a slotted sleeve (8) extending in circumferential direction about the sleeve and terminating with two opposed end regions (9, 10) which overlap leaving an inner end region (10) lapped by an outer end region (9), the sleeve being prestressed with the end regions pressing against each other, and an actuating element for producing a relative movement between the end regions (9, 10) when the pedal arm (3) moves.

2. The pedal assembly as claimed in claim 1, wherein the restoring spring (5) is a leg spring, and the sleeve (8) bears with its outer circumference against an inside of the restoring spring (5).

3. The pedal assembly as claimed in claim 1, wherein the inner end region (10) of the sleeve (8) is fastened on the retaining part (1).

4. The pedal assembly as claimed in claim 1, wherein the outer end region (9) of the sleeve (8) is fastened on the restoring spring (5).

5. The pedal assembly as claimed in claim 1, wherein the sleeve (8) has a friction lining (11) on its end regions (9, 10).

6. The pedal assembly as claimed in claim 5, wherein the sleeve (8) has a coating as the friction lining (11).

7. The pedal assembly as claimed in claim 1, wherein the sleeve (8) or a friction lining (11) on the end regions of the sleeve has fillers.

8. The pedal assembly as claimed in claim 7, wherein the fillers of the friction lining (11) comprise Teflon.

9. The pedal assembly as claimed in claim 5, wherein the friction lining (11) is sintered onto the sleeve (8).

10. The pedal assembly as claimed in claim 1, wherein the actuating element is the at least one restoring spring (5).

11. A pedal assembly comprising a pedal arm which is mounted pivotally in a retaining part, a restoring spring for pivoting the pedal arm back into an initial position, a desired-value generator mechanically coupled to the pedal arm for producing an electrical signal as a function of position of the pedal arm, and a fictional damper for damping movement of the pedal arm, wherein the frictional damper comprises a slotted sleeve extending in circumferential direction and terminating with two opposed end regions which overlap leaving an inner end region lapped by an outer end region, the sleeve being compressed by the restoring spring during advancement of the pedal arm with the end regions pressing against each other to develop a damping force.

12. A pedal assembly according to claim 11 wherein, upon a retraction of the pedal arm, the restoring spring reduces compression of the sleeve for a reduction in the damping force, the damping forces developed during advancement and retraction of the pedal arm being characterized by hysteresis.

13. A pedal assembly according to claim 12 wherein the sleeve is encircled by the restoring spring enabling a reduction in diameter of the restoring spring, occurring with advancement of the pedal arm, to provide compression of the sleeve.

* * * * *